US005554051A

United States Patent [19]

Shinji et al.

[11] Patent Number: 5,554,051

[45] Date of Patent: Sep. 10, 1996

[54] DOUBLE-LOCK TYPE CONNECTOR

[75] Inventors: Yasuhisa Shinji; Kazuhiro Morishita, both of Shizuoka, Japan

[73] Assignee: Yazaki Corporation, Tokyo, Japan

[21] Appl. No.: 397,497

[22] Filed: Mar. 2, 1995

[30] Foreign Application Priority Data

Mar. 7, 1994 [JP] Japan ..... 6-35743

[51] Int. Cl.[6] ..... H01R 13/436

[52] U.S. Cl. ..... 439/595; 439/752

[58] Field of Search ..... 439/595, 752

[56] References Cited

U.S. PATENT DOCUMENTS

| | | | |
|---|---|---|---|
| 3,648,213 | 3/1972 | Kobler . | |
| 4,946,398 | 8/1990 | Takenouchi et al. | 439/752 |
| 5,059,142 | 10/1991 | Ohta et al. | 439/752 |
| 5,186,662 | 2/1993 | Yuasa et al. | 439/752 |

FOREIGN PATENT DOCUMENTS 3-269979 12/1991 Japan .

*Primary Examiner*—Gary F. Paumen

*Attorney, Agent, or Firm*—Armstrong, Westerman, Hattori, McLeland & Naughton

[57] ABSTRACT

A double-lock type connector includes a housing having a pair of locking lances for locking a terminal, and a holder having a pair of locking arms for locking the terminal when inserted into the housing. The housing has a pair of guide paths into which the pair of locking arms advance, and a pair of paths continuous with the pair of guide paths. While the holder is in the temporarily locked position where the locking arms are out of engagement with the terminals, a lance-unlocking tool is inserted into the housing form an opening on one side of the housing and an arm-unlocking tool is inserted into the housing from an opening on the other side of the housing. Thus, the locking lances and locking arms are both out of engagement with the terminal. The locking arms are at the guide paths when the holder is in the temporarily locked position. The arm-unlocking tool has a pair of prongs that goes into contact with the pair of locking arms when inserted into the housing. The arm-unlocking tool has a pair of prongs that goes into contact with the surface of the locking arm facing the terminal when inserted into the housing. The arm-unlocking tool is then pulled out of the housing together with the wires connected to the terminals, while the prongs of the arm-unlocking tool urging the locking arms to deflect away from each other.

8 Claims, 3 Drawing Sheets

DOUBLE-LOCK TYPE CONNECTOR

FIELD OF THE INVENTION

The present invention relates to a double-lock type connector where a terminal is locked by both a locking lance in the housing and a holder having a lock arm, and a mechanism for facilitating to unlock the double-lock type connector.

PRIOR ART

FIG. 6 illustrates a conventional double-lock type connector disclosed in Japanese Patent Preliminary Publication No. 3-269979. A double-lock type connector 40 includes a housing 43, female terminal 45, and rear holder 47. The housing is made of a synthetic resin and has a flexible locking lance 42 in a cavity 41. The female terminal 45 is housed in the cavity 41 and locked at a rear upper end portion 44*a* of a box-like contact 44 by the locking lance 42. The rear holder 47 has flexible locking arms 46 that abuts the rear upper end portion 44*a* of the terminal 45, and is inserted from the rear of the housing 43.

The locking lances 42 extend downwardly obliquely from the upper wall of the cavity 41. The locking arms 46 of the rear holder 47 extend along the locking lances from the upper portion of the cavity 41, and is somewhat kinked to downwardly extend from a mid point thereof in an oblique direction. The tip end portion of the locking arm 46 and locking lance 42 engage the terminal 45, respectively, to lock the terminal 45.

The terminal 45 may be unlocked from the housing 43 as follows: The rear holder 47 is first pulled somewhat rearwardly out of the housing 43, so that a projection not shown of the rear holder 47 engages an engagement not shown of the housing 43. A lance-unlocking tool 48 is then inserted from the forward opening of the housing 43 to prize up the locking lance 42 while also inserting an arm-unlocking tool 49 from the rearward opening to prize up the locking arm 46. Then, a wire 50 is pulled out of the housing to draw the terminal 45.

However, it is quite cumbersome for the worker to retain the lance-unlocking tool 48 with one hand and the arm-unlocking tool 49 with the other hand while also pulling the wire 50. Thus, the prior art construction is disadvantageous in that it is difficult to unlock the terminal as well as the unlocking tool 49 is apt to damage the interior of the housing 43.

SUMMARY OF THE INVENTION

An object of the invention is to provide a double-lock type connector where easy double locking of a terminal in the housing is ensured while preventing an unlocking tool from being damaged. Another object of the invention is to provide an unlock mechanism for unlocking a double-lock type connector.

In the present invention, a double-lock type connector includes a housing having a pair of locking lances for locking a terminal, and a holder having a pair of locking arms for locking the terminal when inserted into the housing. The housing has a pair of guide paths into which the pair of locking arms advance, and a pair of paths continuous with the pair of guide paths.

The holder is in the temporarily locked position when inserted into the housing so that the locking arms are still out of engagement with the terminals. The holder is in the permanently locked position when fully inserted into the housing so that the locking arms are in engagement with the terminals.

While the holder is in the temporarily locked position, a lance-unlocking tool is inserted into the housing form an opening on one side of the housing and an arm-unlocking tool is inserted into the housing from an opening on the other side of the housing. Thus, the locking lances and locking arms are both out of engagement with the terminal. The locking arms are at the guide paths when the holder is in the temporarily locked position. The arm-unlocking tool has a pair of prongs that goes into contact with the pair of locking arms when inserted into the housing. The arm-unlocking tool has a pair of prongs that when inserted into the housing, goes into contact with the surface of the locking arm facing the terminal. The arm-unlocking tool is then pulled out of the housing together with the wires connected to the terminals, while the prongs of the arm-unlocking tool urging the locking arms to deflect away from each other.

BRIEF DESCRIPTION OF THE DRAWINGS

Features and other objects of the invention will become more apparent from the description of the preferred embodiments with reference to the accompanying drawings in which.

DETAILED DESCRIPTION OF THE PREFERRED EMBODIMENTS

Construction

Figure 1:
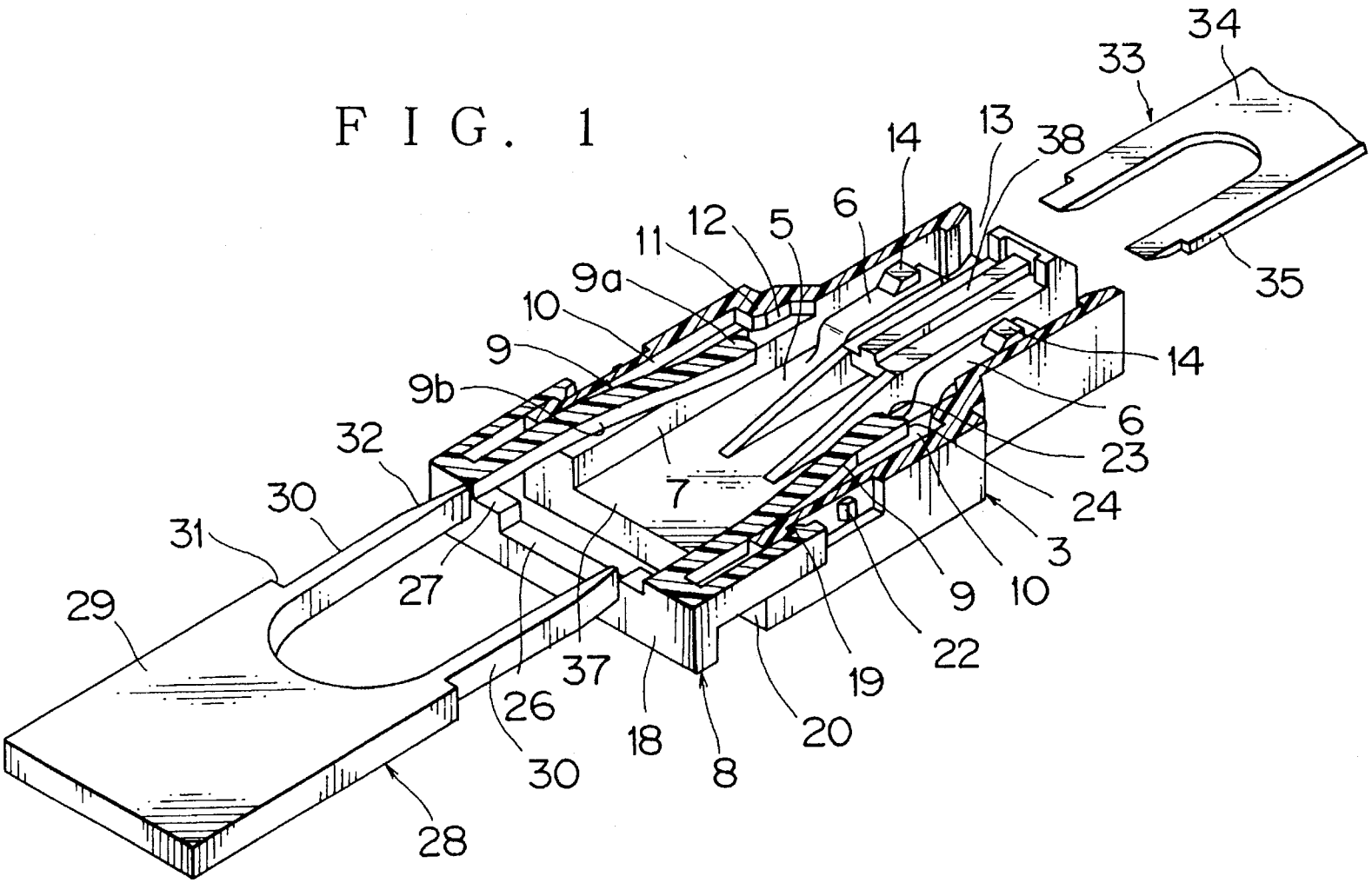
FIG. 1 is a perspective view of an embodiment of a double-lock type connector and an unlock mechanism according to the present invention.
Figure 2:
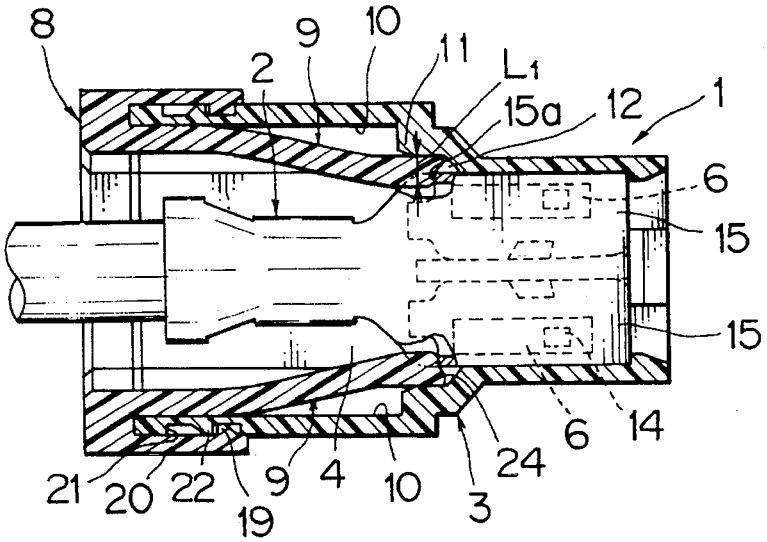
FIG. 2 is a lateral cross-sectional view of a rear holder when it is permanently locked to the housing of the double-lock type connector of the invention.
Figure 3:
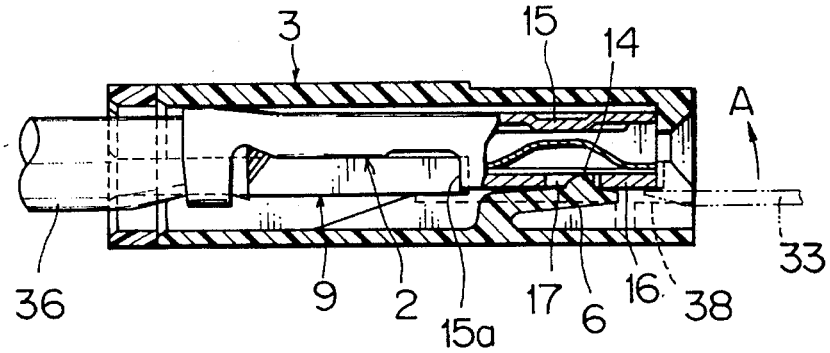
FIG. 3 is a longitudinal cross-sectional view of the double-lock type connector of FIG. 2.
Figure 6:
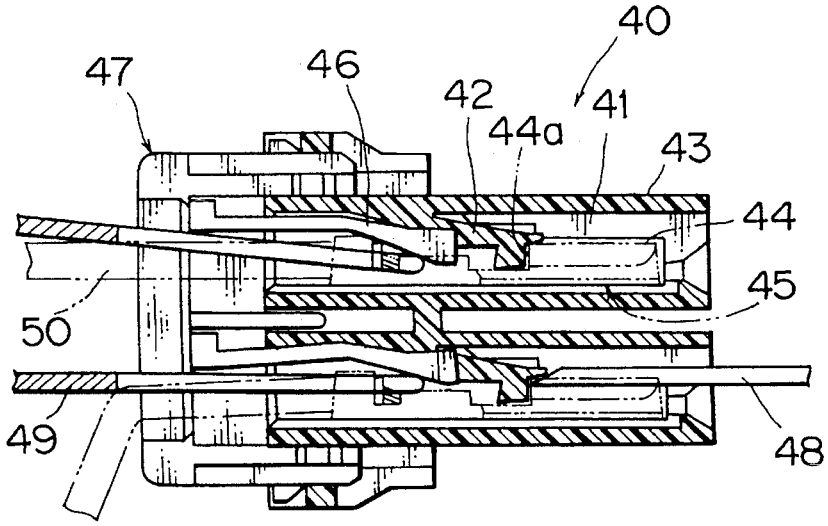
FIG. 6 PRIOR ART
FIG. 6 is a longitudinal cross-sectional view of a prior art connector.

FIGS. 1–5 show a double-lock type connector and an unlock mechanism thereof according to the present invention. The double-lock connector 1 is a connector for use with a power relay which requires reliable locking of a female terminal 2. A housing 3 made of a synthetic resin is formed with flexible locking lances 6 on the base wall 5 of a cavity 4. The cavity 4 is formed with a pair of opposed guide paths 10 and 10 into which a pair of flexible locking arms 9 and 9 of a rear holder 8 are inserted in the longitudinal direction thereof from the rear ends of the paths 10 and 10. There is provided an inwardly stepped portion at the front end of each guide path 10 so as to form a narrow path 12 into which an end portion 9*a* of the locking arm 9 advances. The locking lances 6 and 6 are located at a forward half of the cavity 4. The locking lance rises from the base wall 5 and then extends to a forward opening 13. The locking lance 6 has an upward locking projection 14, which engages an engagement hole 17 in a body 16 of a box-like contact 15 of the female terminal 2 as shown in FIGS. 2 and 3. In this embodiment, the female terminal 2 has a pair of laterally aligned box-like contacts 15 and 15. Each of the pair of locking arms 6 and 6 corresponds to each of the female terminals 2. A guide rail 38 (FIG. 1) for guiding the terminal 2 into the cavity, projects between the pair of locking lances 6 and 6 from the base wall 5 into the cavity 4. The rear holder 8 has a pair of locking arms 9 and 9 projecting from a base 18 parallel to the rear end surface of housing 3. A plurality of pairs of locking arms 9 may be provided in accordance with the number of cavities. For example, the base 18 may be formed with lock pieces 20 integrally continuous therewith at longitudinally opposed ends of the base 18, which lock piece 20 has a locking projection 19. The locking projection 19 engages a temporary locking projection 21 of the housing 3 as shown in FIG. 1 or engages a permanent locking projection 22 as shown in FIG. 2.

The pair of locking arms 9 and 9 are slightly curved toward each other. The tip end portion 9*a* of each arm 9 is formed with an abutment surface 23 thereon which abuts the side 15*a* of the rear end of the box-like contact 15 of the terminal 2. The tip end portion 9*a* also has a click that slightly outwardly projects forwardly of the arm 9 from the abutment surface 23. As shown in FIG. 1, the end portion 9*a* extends away from the guide path 10 toward the middle of the cavity when the rear holder 8 is in the temporary locked position as shown in FIG. 1, and the end portion 9*a* engages the narrow path 12 when the rear holder 8 is in the permanently locked position as shown in FIG. 2.

The narrow path 12 has a width narrower than the lateral width L1 of the arm end portion 9*a* so that the abutment surface 23 of the arm end portion 9*a* slightly projects from the path 12 to abut the side 15*a* of the rear end of the box-like contact 15 of the terminal 2 when the rear holder 8 is in the permanently locked position. The click 24 of the arm end portion 9*a* is in contact with the surface of the path 12 so that the arm end portion 9*a* is sandwiched between the terminal 2 and the housing 3. The locking projection 14 of the locking lance 6 engages the engagement hole 17 of the terminal 2 as shown in FIG. 3 so that the terminal 2 is held on the guide rail 38 in the cavity 4.

Figure 4:
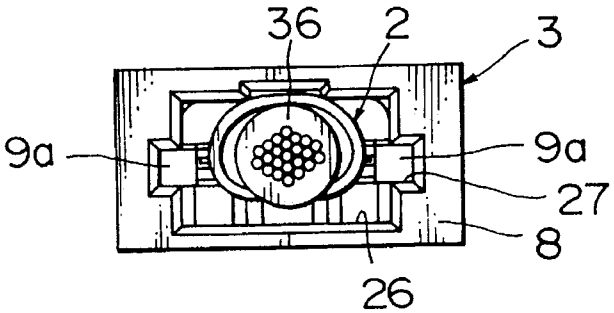
FIG. 4 is a rear view of the double-lock type connector of FIG. 2.

As shown in FIGS. 1 and 4, the base 18 of the rear holder 8 is formed with a terminal-receiving hole 26 and a hole 27 therein into which the arm-unlocking tool 28 is inserted. The arm-unlocking tool 28 has a pair of parallel prongs 30 and 30 that extend straightly longitudinally of a plate-like grip 29. The plate-like grip is formed with a step 31 on the lateral end portion thereof adjacent to the base of each prong 30. The prong 30 has a curved taper 32 on the outer side thereof. When inserted into the housing 3, the curved taper 32 cams the locking arm 9 laterally out of the way. The hole 27 is just wide enough for the two prongs 30 and 30 to enter the housing 3.

Unlocking operation

Figure 5:
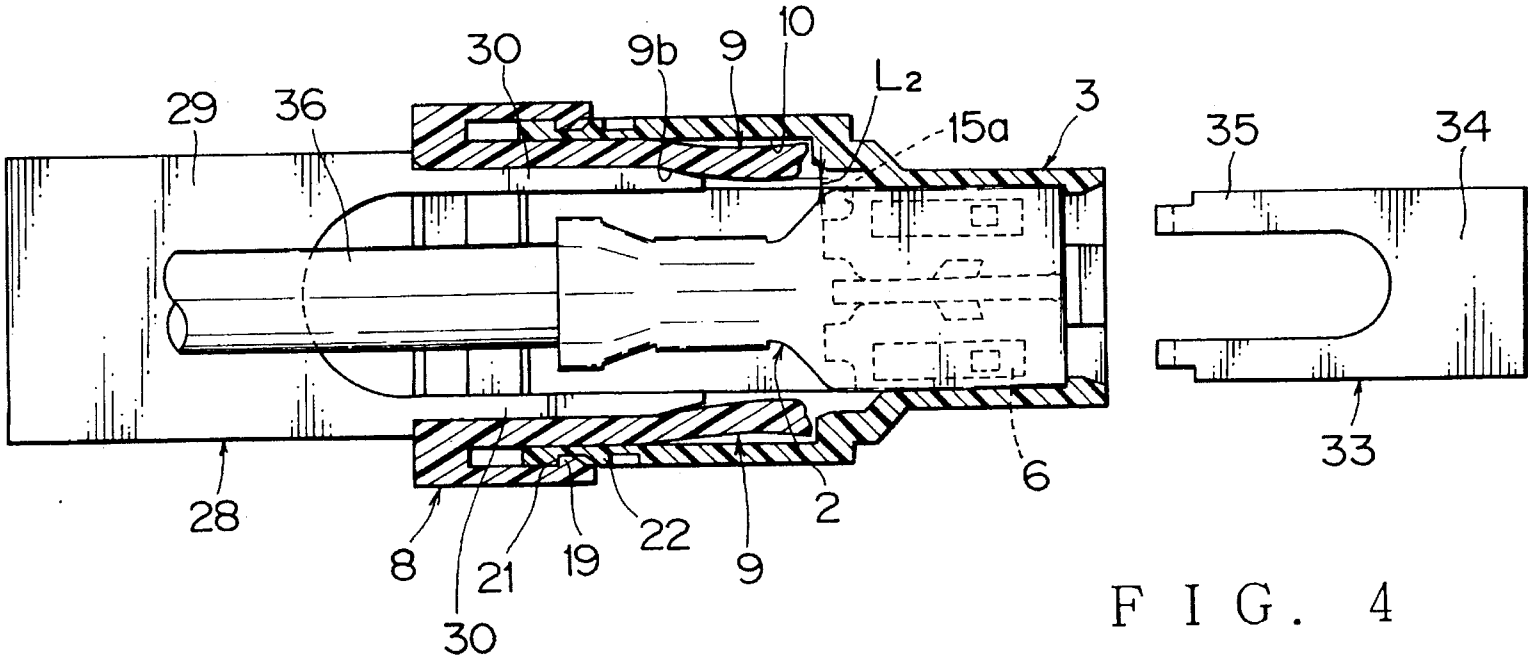
FIG. 5 is a lateral cross-sectional view of the double-lock type connector when the rear holder is temporarily locked.

The unlocking operation of the locking arms 9 and locking lances 6 is performed as follows:

As shown in FIG. 5, the prongs 30 and 30 of the arm-unlocking tool are inserted along the surface 9*b* of the locking arms 9 and 9 into the housing 3 while the rear holder 8 is in the temporarily locked position. The locking arms 9 and 9 are pushed laterally by the prongs 30 and 30 to outwardly deflect away from each other, leaving a lateral distance $L_2$ between the side 15*a* of the rear end of the terminal 2.

The lance-unlocking tool 33 is inserted through the forward opening 13 of the housing 3 as shown in FIGS. 1 and 3. The lance-unlocking tool 33 has a plate-like grip 34 from which a pair of prongs 35 project longitudinally. The prongs 35 have a relatively wide width and are tapered with a curve to provide coplanar tip surfaces. As shown in FIG. 3, the tip end of the prong 35 is pushed into the small gap between the terminal 2 and the locking lance 6, and is then swung in the direction of arrow A, thereby releasing the terminals 2 from locked condition.

The operator inserts the arm-unlocking tool 28 through the hole 27 into the housing 3. Holding the lance-unlocking tool 33 and the housing 3 with one hand, the operator holds both the arm-unlocking tool 28 and the wire 36 connected to the terminal 2 and then pulls them straightly out of the housing 3. This simple unlocking operation eliminates the necessity of prizing of the terminal 2 and the locking arms 9 with the arm-unlocking 28 as in the prior art, and therefore the possibility of damaging the locking arms and terminals.

The aforementioned embodiment has been described with respect to the locking arms 9 which urges the side 15*a* of the rear end portion of the terminal 2. Alternatively, the terminal 2 may be urged vertically as far as the locking arm 9 deflects in a direction perpendicular to the direction in which the locking lance 6 resiliently deflects. Another alternative is that the terminal 2 may be urged a front end portion thereof if a front holder is used in stead of the rear holder 28.

What is claimed is:

1. A double-lock type connector comprising:

a housing and a holder inserted into said housing, said housing including at least one looking lance which resiliently deflects to lock a terminal when said terminal is inserted into said housing;

a pair of locking arms provided on said holder which resiliently deflect to lock said terminal when said holder is inserted into said housing;

a pair of first paths provided in said housing and a pair of second paths each of which is continuous with a forward end of a respective one of said pair of first paths;

each of said locking arms resiliently deflecting in a direction perpendicular to the direction in which said locking lance deflects; and first and second locking positions provided in said housing; wherein said pair of locking arms is guided into said pair of first paths when said holder is inserted to said first locking position, said locking arms being guided into said second paths when said holder is further inserted to said second locking position, thereby permanently locking the terminal.

2. The double-lock connector according to claim 1, wherein said pair of second paths are closer to each other than said pair of first paths are, and each said locking arm advances into the respective second path to be firmly sandwiched between a wall of said second path and a rear end of the terminal when said holder is fully inserted to said second locking position.

3. The double-lock connector according to claim 1, said locking lance includes a projection that engages a hole in the terminal to lock said terminal.

4. The double-lock connector according to claim 1, wherein a lance-unlocking tool having a pair of prongs is inserted through an opening on a first side of the housing to bring said locking lance out of engagement with the terminal after said holder is pulled out to said first locking position, and an arm-unlocking tool is inserted into the housing through an opening on a second side of the housing to bring said locking arms out of engagement with the terminal; and said arm-unlocking tool includes a pair of prongs, each of said pair of prongs urging each of said locking arms when said arm-unlocking tool is inserted into the housing; whereby said prongs urge said locking arms to deflect away from each other perpendicularly to the direction in which the locking lance deflects, said locking arms then being pulled out of the housing together with the wires connected to the terminal while the prongs of the arm-unlocking tool urging the locking arms to deflect away from each other, thereby unlocking the terminal.

5. The double-lock connector according to claim 4, wherein said holder includes a hole through which said arm-unlocking tool is inserted into the housing, said hole including walls that define a part of said hole, each of said walls being continuous with a surface of each of said pair of locking arms, said surfaces being opposed to each other.

6. The double-lock type connector according to claim 4, wherein each of said prongs of said arm-unlocking tool is tapered toward a tip end thereof, the tapered surface of one prong opposes that of the other.

7. The double-lock type connector according to claim 4, wherein each of said prongs of said lance-unlocking tool has a tapered surface at a tip end thereof, the tapered surfaces of said prongs being coplanar.

8. The double-lock type connector according to claim 4, wherein said housing is formed with a first projection and a second projection thereon, said holder is formed with a third projection thereon, and said third projection engages said second projection when said holder is in said first locking position and engages said first projection when said holder is in said second locking position.

* * * * *